US012622522B1

(12) United States Patent
Zhang

(10) Patent No.: US 12,622,522 B1
(45) Date of Patent: May 12, 2026

(54) PORTABLE ROCKING CHAIR

(71) Applicant: Ninghai Jiarun Hardware Co., Ltd., Ningbo (CN)

(72) Inventor: Zhenguo Zhang, Ningbo (CN)

(73) Assignee: Ninghai Jiarun Hardware Co., Ltd., Ningbo (CN)

( * ) Notice: Subject to any disclaimer, the term of this patent is extended or adjusted under 35 U.S.C. 154(b) by 0 days.

(21) Appl. No.: 19/360,981

(22) Filed: Oct. 16, 2025

(30) Foreign Application Priority Data

Sep. 17, 2025 (CN) ..... 202521999517.6

(51) Int. Cl.

| | |
|---|---|
| ***A47C 3/02*** | (2006.01) |
| ***A47C 3/021*** | (2006.01) |
| ***A47C 3/023*** | (2006.01) |
| ***A47C 3/025*** | (2006.01) |
| ***A47C 4/03*** | (2006.01) |
| ***A47C 4/28*** | (2006.01) |
| ***A47C 4/30*** | (2006.01) |
| ***A47C 7/44*** | (2006.01) |

(52) U.S. Cl.
CPC ..... *A47C 3/02* (2013.01); *A47C 3/021* (2013.01); *A47C 3/023* (2013.01); *A47C 3/025* (2013.01); *A47C 4/03* (2013.01); *A47C 4/28* (2013.01); *A47C 4/286* (2013.01); *A47C 4/30* (2013.01); *A47C 7/44* (2013.01); *A47C 7/443* (2013.01)

(58) Field of Classification Search
CPC .... A47C 3/02; A47C 4/03; A47C 4/28; A47C 4/283; A47C 4/286; A47C 4/30; A47C 7/44; A47C 7/443; A47C 3/021; A47C 3/023; A47C 3/025
See application file for complete search history.

(56) References Cited

U.S. PATENT DOCUMENTS

| | | | | | |
|---|---|---|---|---|---|
| 2,473,090 | A * | 6/1949 | Becker | A47C 4/286 | 297/45 X |
| 4,047,752 | A * | 9/1977 | Rohr | A47C 4/286 | 297/440.11 |
| 4,251,106 | A * | 2/1981 | Gilbert | A47C 3/02 | 297/18 |
| 4,258,951 | A * | 3/1981 | Groom | A47C 4/286 | 297/16.2 |
| 4,938,532 | A * | 7/1990 | Burgess | A47C 7/445 | 297/301.5 |
| 5,039,163 | A * | 8/1991 | Tolleson | A47C 7/445 | 297/297 |

(Continued)

*Primary Examiner* — Rodney B White

(57) ABSTRACT

A portable rocking chair includes upper and lower support seats, being mutually limited and movably connected. The upper support seat is connected to one or more rear support rods, and the lower support seat is connected to one or more rear support legs. Upper ends of one or more front support rods and the rear support rods are jointly connected to a chair fabric, which has a seat area and a backrest area for supporting buttocks and back of a human body respectively. When the rocking chair is unfolded, one or more front support legs, the rear support legs, and the front support rods remain at a stationary position relative to the ground. The rear support rods swing back and forth following movement of the upper support seat relative to the lower support seat, thereby driving the backrest area of the chair fabric to tilt forward or rock backward.

10 Claims, 13 Drawing Sheets

(56) References Cited

U.S. PATENT DOCUMENTS 5,452,937 A * 9/1995 Piretti ..... A47C 4/03 297/301.4
5,904,397 A * 5/1999 Fismen ..... A47C 7/405 297/296 X
6,779,846 B2 * 8/2004 Spendlove ..... A47C 7/445 297/296 X
7,021,712 B2 * 4/2006 Spendlove ..... A47C 7/445 297/285
7,118,177 B2 * 10/2006 Piretti ..... A47C 7/44 297/296 X
7,416,252 B2 * 8/2008 Lor ..... A47C 7/445 297/285
7,681,952 B2 * 3/2010 Piretti ..... A47C 7/445 297/297
8,454,084 B2 * 6/2013 Lah ..... A47C 9/105 297/16.2
8,899,686 B1 * 12/2014 Kim ..... A47C 4/286 297/16.1 X
9,295,332 B2 * 3/2016 Barile ..... A47C 7/021
9,326,612 B2 * 5/2016 Kim ..... A47C 9/10
9,351,578 B2 * 5/2016 Homans ..... A47C 4/02
9,414,683 B2 * 8/2016 Barile ..... A47C 3/04
9,854,914 B2 * 1/2018 Yoo ..... A47C 4/286
9,930,966 B2 * 4/2018 Yang ..... A47C 4/286
10,010,179 B1 * 7/2018 Stump ..... A47C 4/44
10,285,503 B2 * 5/2019 Graybill ..... A47C 4/02
10,342,351 B2 * 7/2019 Lenhart ..... A47C 4/286
10,531,740 B2 * 1/2020 Graybill ..... A47C 4/02
10,653,244 B2 * 5/2020 Yang ..... A47C 3/025
11,122,904 B2 * 9/2021 Zhang ..... A47C 4/022
11,166,558 B2 * 11/2021 Leach ..... A47C 4/02
11,253,075 B2 * 2/2022 Lah ..... A47C 4/42
11,350,755 B2 * 6/2022 Hu ..... A47C 4/30
11,369,202 B2 * 6/2022 Graybill ..... A47C 4/03
11,439,238 B1 * 9/2022 Wang ..... A47C 3/40
11,672,350 B2 * 6/2023 Graybill ..... A47C 9/10 297/25
11,700,922 B2 * 7/2023 Davis ..... A45B 5/00 297/16.1
11,700,943 B1 * 7/2023 Wang ..... A47C 4/286 297/16.2
11,737,564 B2 * 8/2023 Chen ..... A47C 4/286 297/47
11,786,041 B1 * 10/2023 Chen ..... A47C 4/42 297/16.1
11,805,912 B2 * 11/2023 Zhu ..... A47C 4/02
11,844,439 B1 * 12/2023 Wang ..... A47C 3/40
11,864,660 B1 * 1/2024 Wang ..... F16M 11/242
11,871,848 B1 * 1/2024 Wang ..... A47C 4/286
11,937,709 B2 * 3/2024 Xu ..... A47B 3/12
11,969,102 B2 * 4/2024 Sun ..... A47C 3/025
11,980,292 B1 * 5/2024 Wang ..... A47C 7/14
11,980,296 B2 * 5/2024 Kim ..... A47C 3/12
11,986,103 B1 * 5/2024 Li ..... A47C 4/30
11,998,094 B2 * 6/2024 Davis ..... A47C 9/105
12,059,079 B1 * 8/2024 Chen ..... A47C 4/286
12,127,687 B1 * 10/2024 Zhang ..... A47C 4/30
RE50,266 E * 1/2025 Graybill ..... A45B 5/00
12,185,831 B2 * 1/2025 Xu ..... A47B 13/02
12,185,843 B2 * 1/2025 Yuan ..... A47C 4/286
12,220,064 B2 * 2/2025 He ..... A47C 4/44
12,349,806 B1 * 7/2025 Wang ..... A47C 3/025
12,390,013 B2 * 8/2025 Sun ..... A47C 3/0255
12,396,560 B2 * 8/2025 Zhang ..... A47C 4/28
12,414,631 B2 * 9/2025 Zhang ..... A47C 4/30
12,419,422 B2 * 9/2025 Zhang ..... A47C 4/286
12,433,406 B2 * 10/2025 Sun ..... A47C 4/021
12,514,372 B2 * 1/2026 Zhu ..... A47C 4/286
2016/0113402 A1 * 4/2016 Lee ..... A47C 4/42 297/16.2
2017/0188709 A1 * 7/2017 Bergling ..... A47C 9/105
2021/0112985 A1 * 4/2021 Brensinger ..... A47C 1/0248
2023/0023969 A1 * 1/2023 Zhu ..... A47C 4/286
2023/0320487 A1 * 10/2023 Jin ..... A47C 4/286 297/16.2
2023/0407670 A1 * 12/2023 Graybill ..... A45B 5/00
2024/0215728 A1 * 7/2024 Zhu ..... A47C 3/025
2025/0176725 A1 * 6/2025 Fischer ..... A47C 7/004

* cited by examiner

PORTABLE ROCKING CHAIR

CROSS REFERENCE TO RELATED APPLICATIONS

The present application claims the benefit of Chinese Patent Application No. 202521999517.6 filed on Sep. 17, 2025, the contents of which are incorporated herein by reference in their entirety.

TECHNICAL FIELD

The present disclosure relates to the technical field of folding rocking chairs, and more particularly to a portable rocking chair.

BACKGROUND TECHNOLOGY

Existing portable rocking chairs typically use foldable or joinable metal rods as the main body of the chair, with a chair fabric connected to upper ends to form a seat surface. The design of this type of rocking chair is mostly based on the concept of traditional rocking chairs, i.e., the rocking effect is achieved by swinging the entire chair fabric or the entire body of the chair. There are mainly the following two common solutions. First, the main structure of the chair is relatively stationary, and the chair fabric is hung on the vertical rods on both sides of the main body. When a user sits down, the chair fabric as a whole swings back and forth relative to the body of the chair, thereby creating a rocking feeling. Second, the chair is divided into two parts. The upper part serves as a swing unit that supports the chair fabric, and the lower part is secured to the ground. The upper and lower parts are connected by a structure to achieve back and forth rocking.

However, these existing portable rocking chairs rely on the back and forth swinging of the entire seat fabric to create a rocking effect. This structure often creates a significant sense of insecurity for users due to the lack of stable, stationary support points. This is especially true when the chair fabric swings, leaving the user's feet suspended in the air. Without contact with the ground or stationary components, users can easily imagine losing their balance or even falling, leading to a lack of security.

SUMMARY

The purpose of the present disclosure is to overcome the defects of existing portable rocking chairs that rely on the overall back and forth swinging of the chair fabric, resulting in a lack of stable support for users and a sense of insecurity when the feet are suspended in the air, and to provide a portable rocking chair that can maintain the rocking experience while improving the sense of security and stability.

The technical solution adopted by the present disclosure is: to provide a portable rocking chair, which includes an upper support seat and a lower support seat, the two being mutually limited and movably connected. The upper support seat is connected to one or more rear support rods, and the lower support seat is connected to one or more rear support legs. One or more front support rods are located forward of the rear support rods. Upper ends of the front support rods and upper ends of the rear support rods are jointly connected to a chair fabric. The chair fabric has a seat area and a backrest area for supporting buttocks and back of a human body respectively. One or more front support legs are located forward of the rear support legs. When the rocking chair is unfolded, the front support legs, the rear support legs, and the front support rods remain in a stationary position relative to the ground. The rear support rods swing back and forth following movement of the upper support seat relative to the lower support seat, thereby driving the backrest area of the chair fabric to tilt forward or rock backward.

After adopting the above technical solution, the present disclosure avoids the prior art method of relying on the entire chair fabric to swing back and forth by setting a movable connection between the upper support seat and the lower support seat, and making the rear support rods drive the backrest area of the chair fabric to swing back and forth. Since the front support legs and the rear support legs cooperate with each other to form a stable support, and the front support rods always remains stationary relative to the ground during use, the user can obtain reliable support points when sitting on the chair fabric and will not feel insecure due to the feet hanging in the air. Furthermore, the front support rods are stationary and do not follow the rear support rods to swing back and forth, so that the front edge of the chair fabric remains stationary. The inner thighs of the user can be stably rested on the front edge of the chair fabric, so that when the body leans forward or swings back, the contact points perceived by the thighs do not move, and the user feels more secure and at ease psychologically.

According to one embodiment of the present disclosure, an elastic member is positionally mounted between the upper support seat and the lower support seat. When the upper support seat swings relative to the lower support seat, the elastic member deforms and provides a restoring force for a swing. This design makes the swinging process smoother, providing a natural reciprocating motion experience for the user. The device automatically returns to its initial position after the force is removed, improving operational convenience and safety.

According to one embodiment of the present disclosure, it further includes a plurality of connecting rods, the plurality of connecting rods being connected to the lower support seat to form a horizontally disposed frame. This structure helps to enhance the overall stability of the rocking chair, making it less likely for the front and rear support legs to deform or deviate during the rocking process, thereby improving the overall load-bearing capacity and service life.

According to one embodiment of the present disclosure, the plurality of connecting rods include a plurality of longitudinal connecting rods, one end of each of the plurality of longitudinal connecting rods being movably connected to the lower support seat, and the other ends of the plurality of longitudinal connecting rods being provided with a plurality of connecting seats for connecting a respective one of the front support legs and/or a respective one of the front support rods. This design allows the front support legs and the front support rods to form stable support points, while also providing reliable fixation via the connecting seats, thereby improving the stability of the rocking chair under various load conditions.

According to one embodiment of the present disclosure, the plurality of connecting rods further include a transverse connecting rod, the transverse connecting rod being configured for connecting two of the plurality of connecting seats. This structure can improve the integrity of the rocking chair in the transverse direction, preventing swaying caused by force application on one side, and thus increasing the overall structural strength and safety.

According to one embodiment of the present disclosure, the plurality of connecting seats include a plurality of second insertion grooves, into which the front support rods and/or the front support legs are inserted and disposed in a front-to-rear direction in a folded state. This design significantly simplifies the folding and storage of the rocking chair, reduces space usage, facilitates carrying and storage, and improves portability.

According to one embodiment of the present disclosure, the lower support seat includes a plurality of first insertion grooves, into which the rear support rods and/or the rear support legs are inserted and disposed in a front-to-rear direction in a folded state. With this solution, the rocking chair can remain compactly arranged after being folded, preventing parts from becoming loose, and improving storage orderliness and transportation convenience.

According to one embodiment of the present disclosure, a spring clip is provided in each of the rear support legs, and the spring clip is engageable with the lower support seat. This design enables quick positioning and secure connection when the rocking chair is unfolded, preventing the legs from accidentally falling off during use, thereby improving safety and reliability.

According to one embodiment of the present disclosure, the upper support seat or the lower support seat is provided with a first limiting portion for triggering limitation when moving to one end of a range of motion. This structure effectively controls the range of swinging, preventing excessive swinging of the upper support seat from causing discomfort to the user or damage to the structure, thereby ensuring safe use.

According to one embodiment of the present disclosure, the upper support seat or the lower support seat is provided with a second limiting portion for triggering limitation when moving to the other end of the range of motion. This design, in conjunction with the first limiting portion, enables effective limiting at both ends, ensuring a stable and controllable swinging process, and further enhancing safety and durability.

According to one embodiment of the present disclosure, the rocking chair has an initial state after being unfolded, the upper support seat is located at any position between a forward tilt position and a backward rock position relative to the lower support seat. When the user sits down, the chair fabric transfers the user's weight to the upper support seat, causing it to move from an initial position to a forward tilt direction, thereby producing a cushioning effect and improving the comfort and safety of sitting.

According to one embodiment of the present disclosure, the rocking chair has an initial state after being unfolded, the upper support seat is located in a forward tilt position or a backward rock position relative to the lower support seat.

DESCRIPTION OF THE DRAWINGS

In order to more clearly illustrate the embodiments of the present disclosure or the technical solutions in the prior art, the following briefly introduces the drawings required for use in the embodiments or the description of the prior art. Obviously, the drawings described below are only some embodiments of the present disclosure. For ordinary technicians in this field, other drawings can be obtained based on these drawings without contributing any creative effort.

DESCRIPTION OF THE REFERENCE NUMERALS IN THE FIGURES

Figure 1:
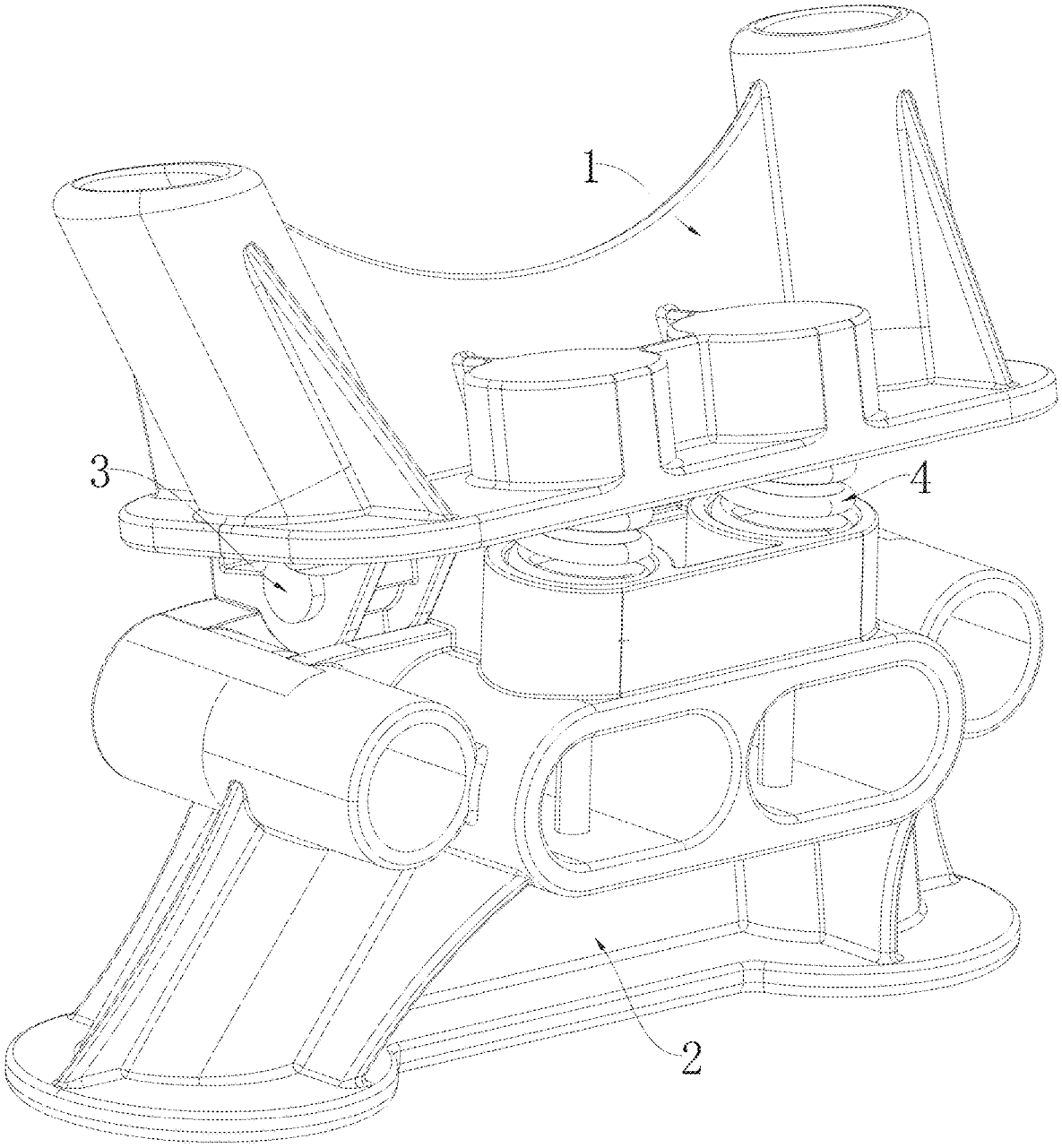
FIG. 1 is a perspective view of an upper support seat and a lower support seat in Embodiment 1 of the present disclosure.
Figure 2:
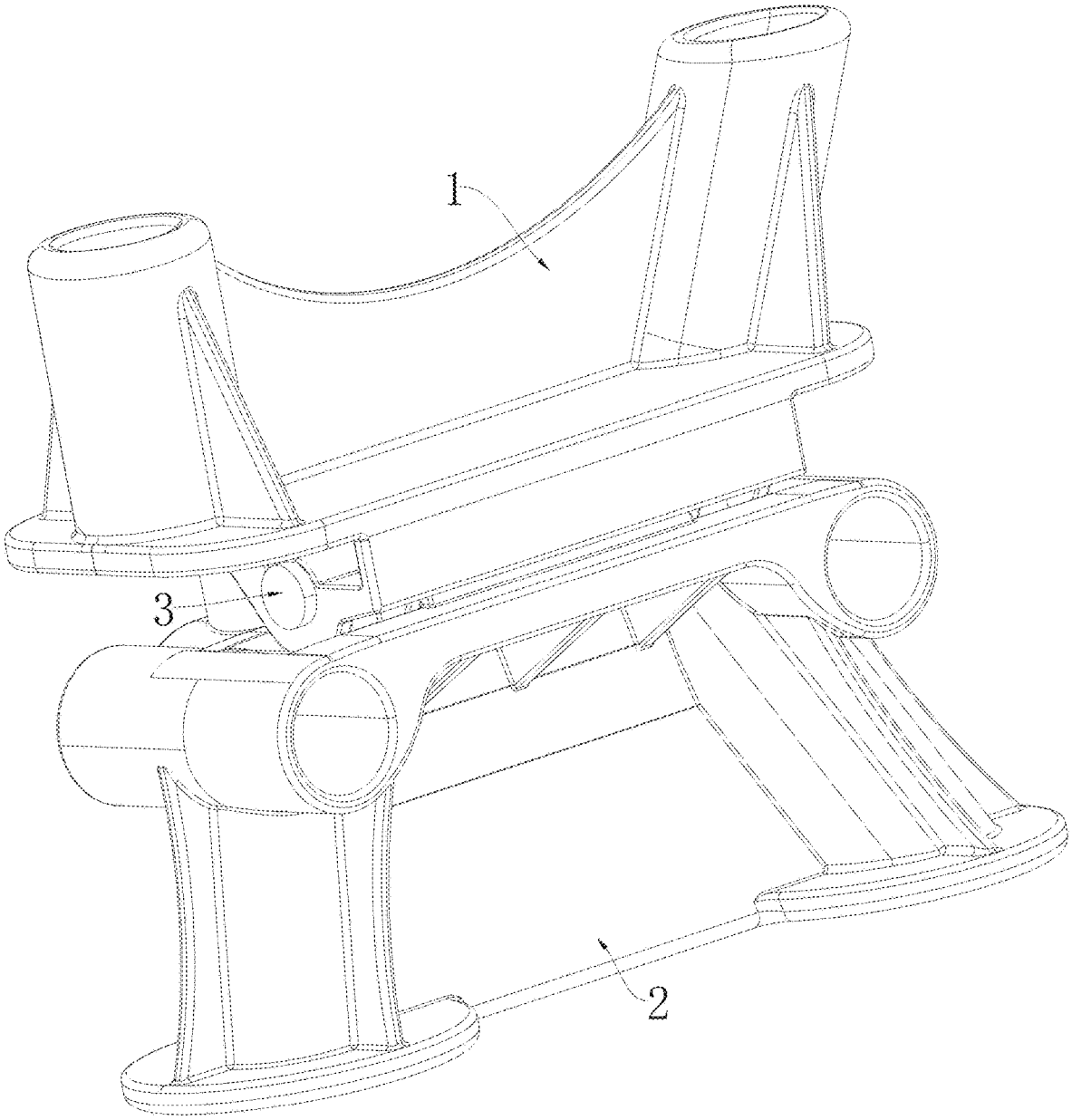
FIG. 2 is a schematic structural diagram of the upper support seat and the lower support seat in Embodiment 1 of the present disclosure.

1. Upper support seat; 2. Lower support seat; 3. Rotating shaft; 4. Elastic member; 5. Rear support leg; 6. Rear support rod; 7. Connecting rod; 8. Front support leg; 9. Front support rod; 10. Connecting seat;

11. Seat body; 12. First connecting portion; 13. First spring seat; 14. First shaft seat; 15. First limiting portion;

21. Second connecting portion; 22. Hinge groove; 23. First insertion groove; 24. Second shaft seat; 25. Second spring seat;

51. Spring clip;

71. Longitudinal connecting rod; 72. Transverse connecting rod;

10*a*. Third connecting portion; 10*b*. Fourth connecting portion; 10*c*. Second insertion groove; 10*d*. Lateral connecting portion.

DETAILED DESCRIPTION OF EMBODIMENTS

The following describes the embodiments of the present disclosure in detail. Examples of the embodiments are shown in the accompanying drawings, wherein the same or similar reference numerals throughout represent the same or similar elements, or elements having the same or similar functions. The embodiments described below with reference to the accompanying drawings are exemplary and are intended only to explain the present disclosure, and are not to be construed as limiting the present disclosure.

Embodiment 1

As shown in FIGS. 1-11, this embodiment discloses a portable rocking chair including an upper support seat 1 and a lower support seat 2, which are mutually limited and movably connected via a rotating shaft 3. The upper end of the upper support seat 1 is connected to one or more rear support rods 6, and the lower end of the lower support seat 2 is connected to one or more rear support legs 5. One or more front support rods 9 are disposed forward of the rear support rods 6. The upper ends of the front support rods 9 and the upper ends of the rear support rods 6 are jointly connected to a chair fabric 16. The chair fabric 16 as a whole includes a seat area 16*a* and a backrest area 16*b*, which are used to support the buttocks and back of a human body, respectively. One or more front support legs 8 are located forward of the rear support legs 5.

When the rocking chair is in an unfolded state, the front support legs 8, rear support legs 5, and front support rods 9 remain at a stationary position relative to the ground. The rear support rods 6 swing back and forth following the swinging movement of the upper support seat 1 relative to the lower support seat 2, thereby driving the backrest area of the chair fabric to tilt forward or rock backward, and realizing the rocking function.

Figure 3:
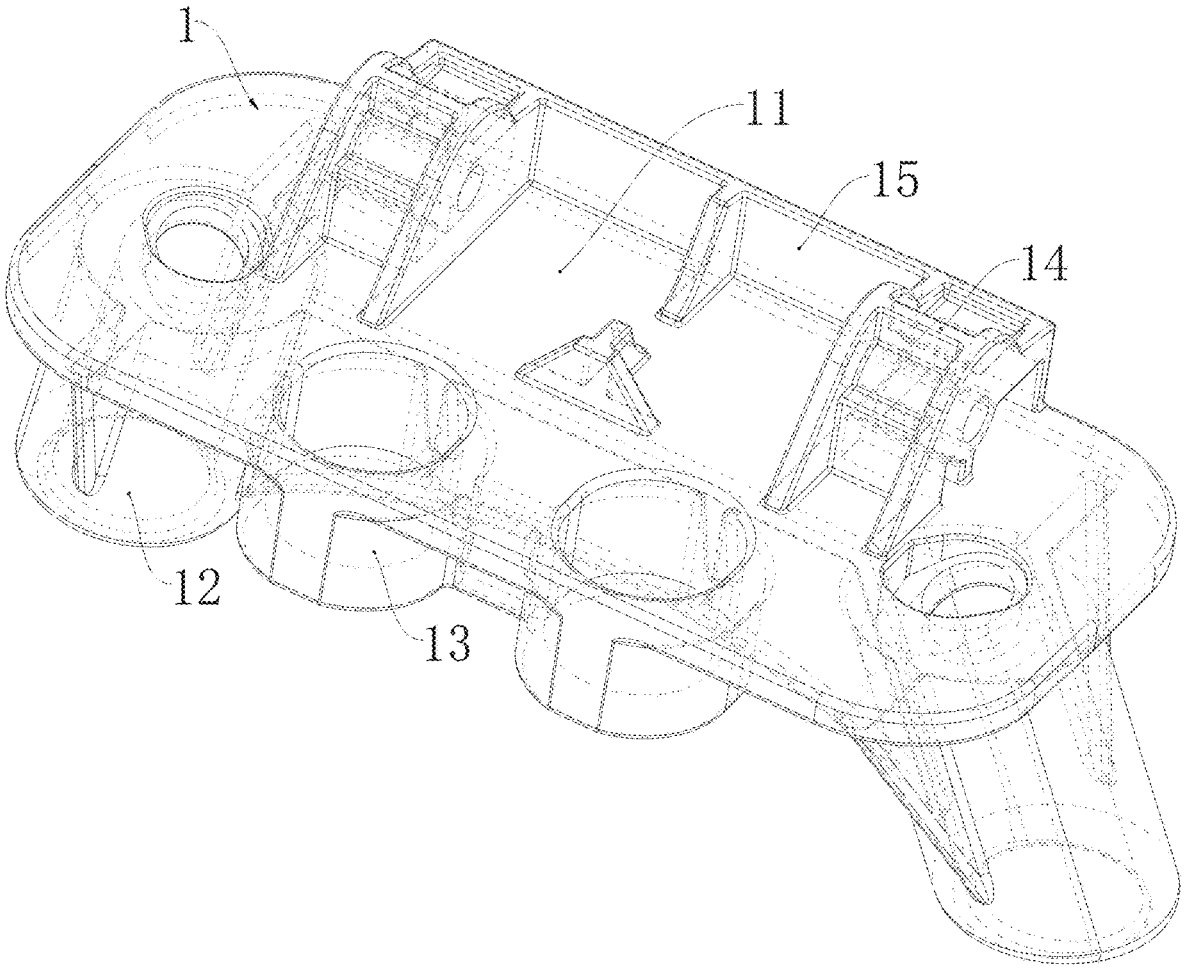
FIG. 3 is a perspective view of the upper support seat in Embodiment 1 of the present disclosure.

Furthermore, as shown in FIG. 3, the upper support seat 1 includes a seat body 11, the upper end of which is inclinedly provided with one or more first connecting portions 12. The first connecting portions 12 adopt an insertion groove structure, into which the lower ends of the rear support rods 6 are inserted, achieving a reliable and detachable fit. Since the rear support rods 6 supports the backrest, their length is designed to be greater than that of the front support rods 9, so that the backrest area is higher than the seat area. The lower end of the seat body 11 is provided with a first shaft seat 14 and one or more groove-shaped first spring seats 13. A first limiting portion 15 is integrally provided on a rear side of the first shaft seat 14 to limit the range of the swing motion.

Figure 4:
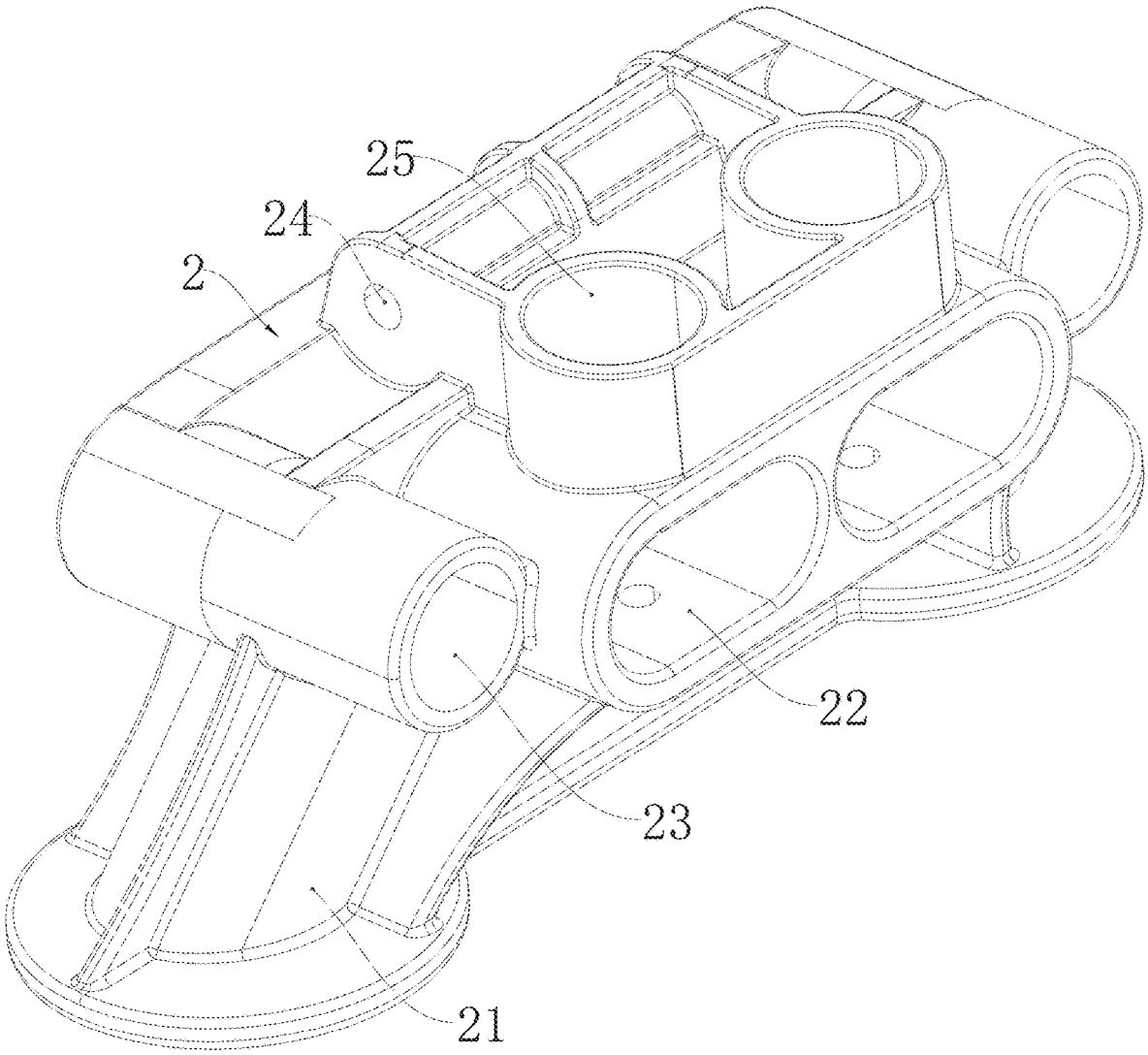
FIG. 4 is a perspective view of the lower support seat in Embodiment 1 of the present disclosure.

Furthermore, as shown in FIG. 4, one or more second connecting portions 21 are provided at a lower end of the lower support seat 2, which adopt an insertion groove structure.

The upper ends of the rear support leg 5 are inserted into and matched with the second connecting portions 21 to ensure that the rear support legs 5 are firmly supported. A plurality of hinge grooves 22 are provided on a front side of the lower support seat 2. One end of each of a plurality of longitudinal connecting rods 71 is inserted into a respective one of the hinge grooves 22 and forms a hinge connection with the lower support seat 2. The lower support seat 2 is provided with a plurality of first insertion grooves 23 in a front-to-rear direction for the rear support rods 6 and/or the rear support legs 5 to be inserted and disposed in a front-to-rear direction in the folded state. One or more second spring seats 25 and a second shaft seat 24 are provided at the upper end of the lower support seat 2. The second shaft seat 24 cooperates with the first shaft seat 14 of the upper support seat 1 to form an installation position for the rotating shaft 3, so that the upper support seat 1 can rotate around the rotating shaft 3 relative to the lower support seat 2.

Figure 8:
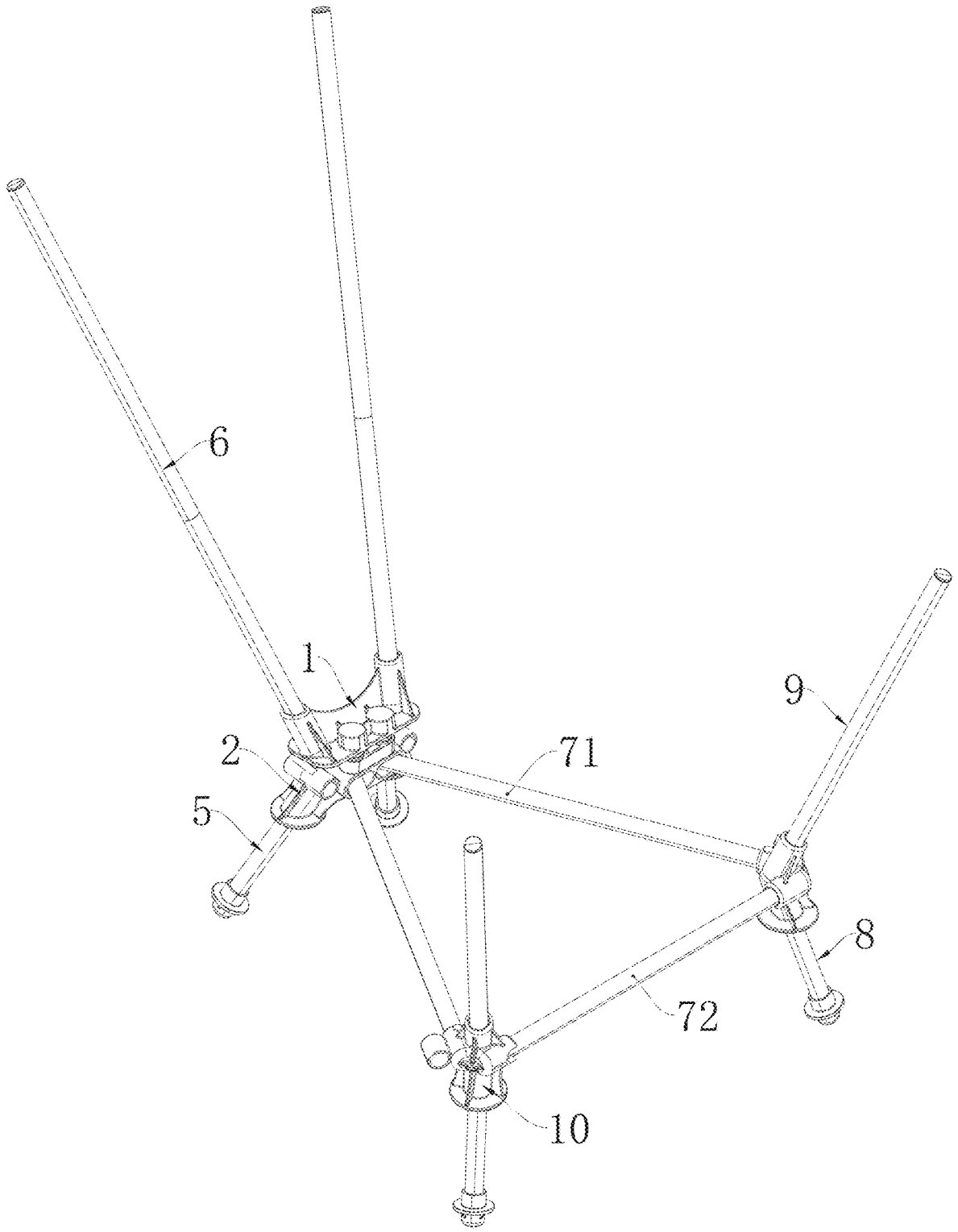
FIG. 8 is a perspective view of the rocking chair in Embodiment 1 of the present disclosure.

Furthermore, as shown in FIG. 8, in the unfolded state, two longitudinal connecting rods 71, one transverse connecting rod 72, and the lower support seat 2 together form a frame structure that is substantially triangular in shape. The frame structure is disposed horizontally, which significantly improves the overall stability. In the folded state, the longitudinal connecting rods 71 can be folded in parallel for easy folding and storage.

Figure 9:
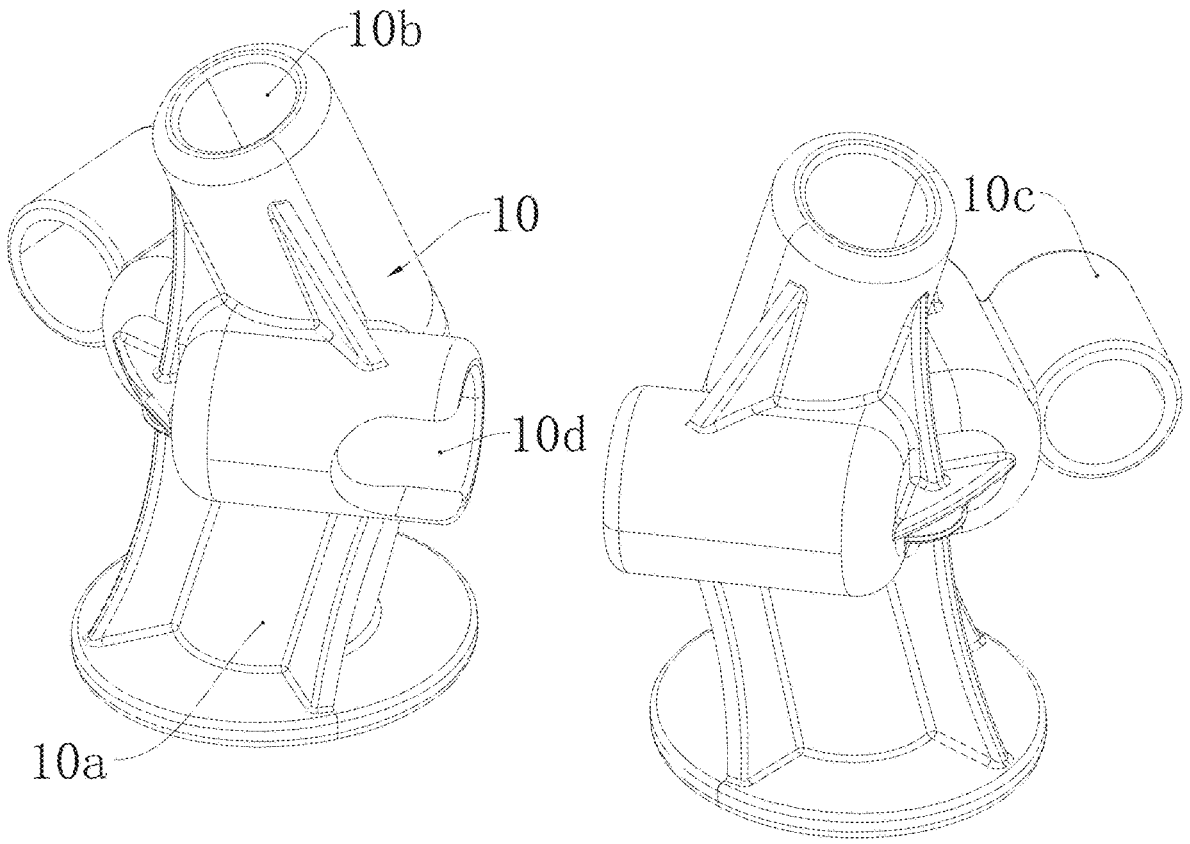
FIG. 9 is a perspective view of the connecting seat in Embodiment 1 of the present disclosure.

Specifically, as shown in FIG. 9, a plurality of connecting seats 10 are each provided with a third connecting portion 10*a*, a fourth connecting portion 10*b*, and a lateral connecting portion 10*d*, all of which are insertion groove structures. The upper end of the front support leg 8 is configured to be inserted into and mate with the third connecting portion 10*a*. The lower end of the front support rod 9 is configured to be inserted into and mate with the fourth connecting portion 10*b*. The ends of the transverse connecting rod 72 are respectively inserted into and mate with the lateral connecting portions 10*d* of two of the plurality of connecting seats 10. Thus, the front support rods 9 and the front support legs 8 are securely mounted via the plurality of connecting seats 10, forming reliable force-bearing points.

Furthermore, a second insertion groove 10*c* is provided on each of the plurality of connecting seats 10. When the rocking chair is folded, the front support rods 9 and/or the front support legs 8 can be inserted into the insertion grooves and arranged in a front-to-rear direction to achieve compact storage.

Specifically, as shown in FIG. 1, one or more elastic members 4 are positioned and mounted between the upper support seat 1 and the lower support seat 2. When the upper support seat 1 swings relative to the lower support seat 2, the elastic members 4 deform and provide a restoring force for a swing. In this embodiment, the elastic members 4 are helical compression springs, with their upper and lower ends positioned within the first spring seats 13 and the second spring seats 25, respectively. The compression springs are located forward of the rotating shaft 3. When the upper support seat 1 swings, the elastic members 4 are compressed, generating an elastic restoring force, ensuring that the backrest of the chair automatically returns to its initial position after tilting forward or rocking backward, thereby preventing deviation.

Figure 10:
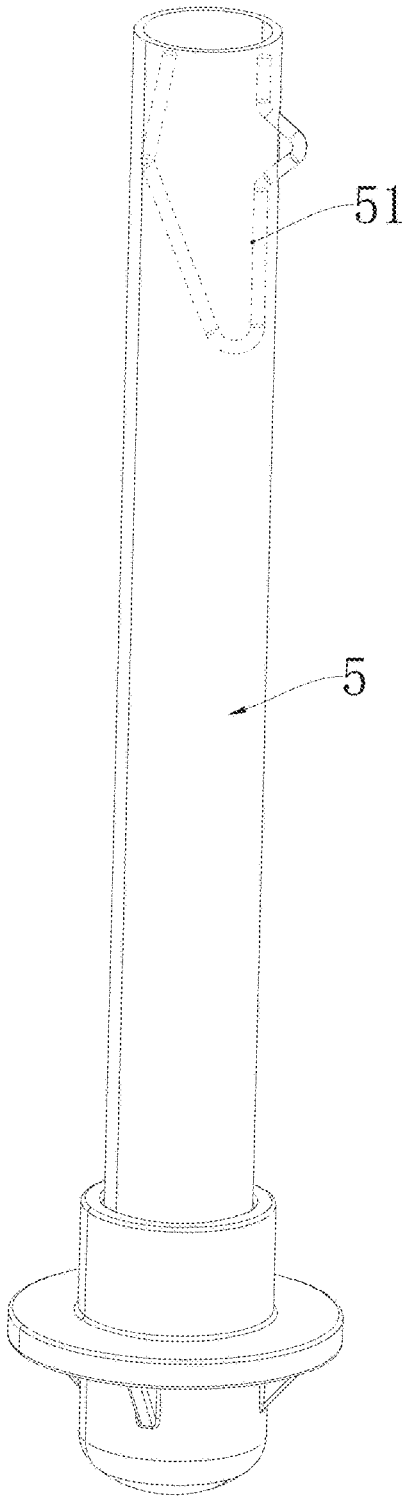
FIG. 10 is a schematic structural diagram of the rear support leg in Embodiment 1 of the present disclosure.
Figure 11:
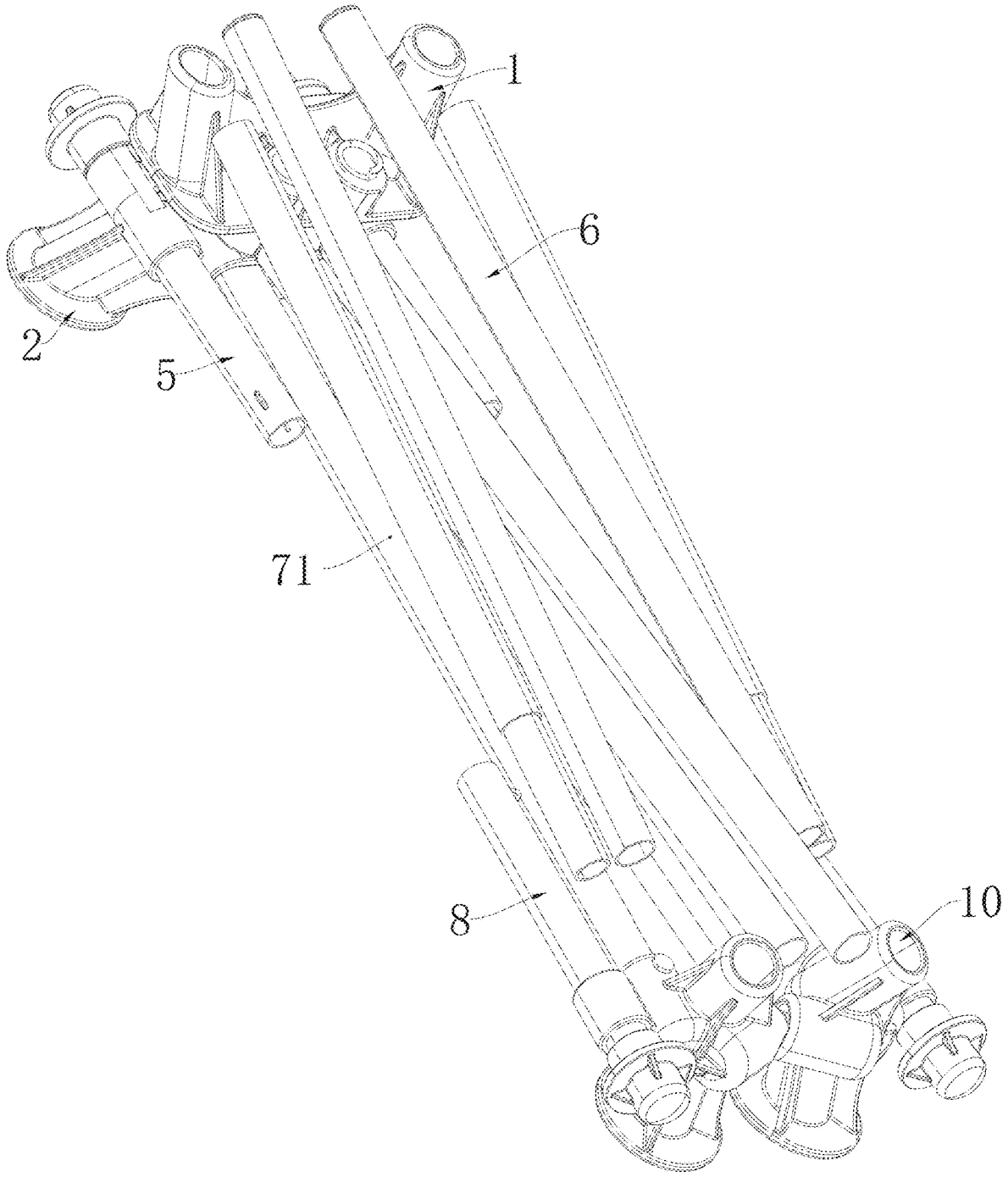
FIG. 11 is a perspective view of the rocking chair in the folded state in Embodiment 1 of the present disclosure.

Specifically, as shown in FIG. 10, the front support legs 8 and the rear support legs 5 are tubular structures, each of which is internally provided with a spring clip 51. When the rear support legs 5 are inserted into the second connecting portions 21, the spring clips 51 can securely engage with the inner walls of the second connecting portions 21, thereby providing a positioning function during folding or unfolding operations.

Figure 5:
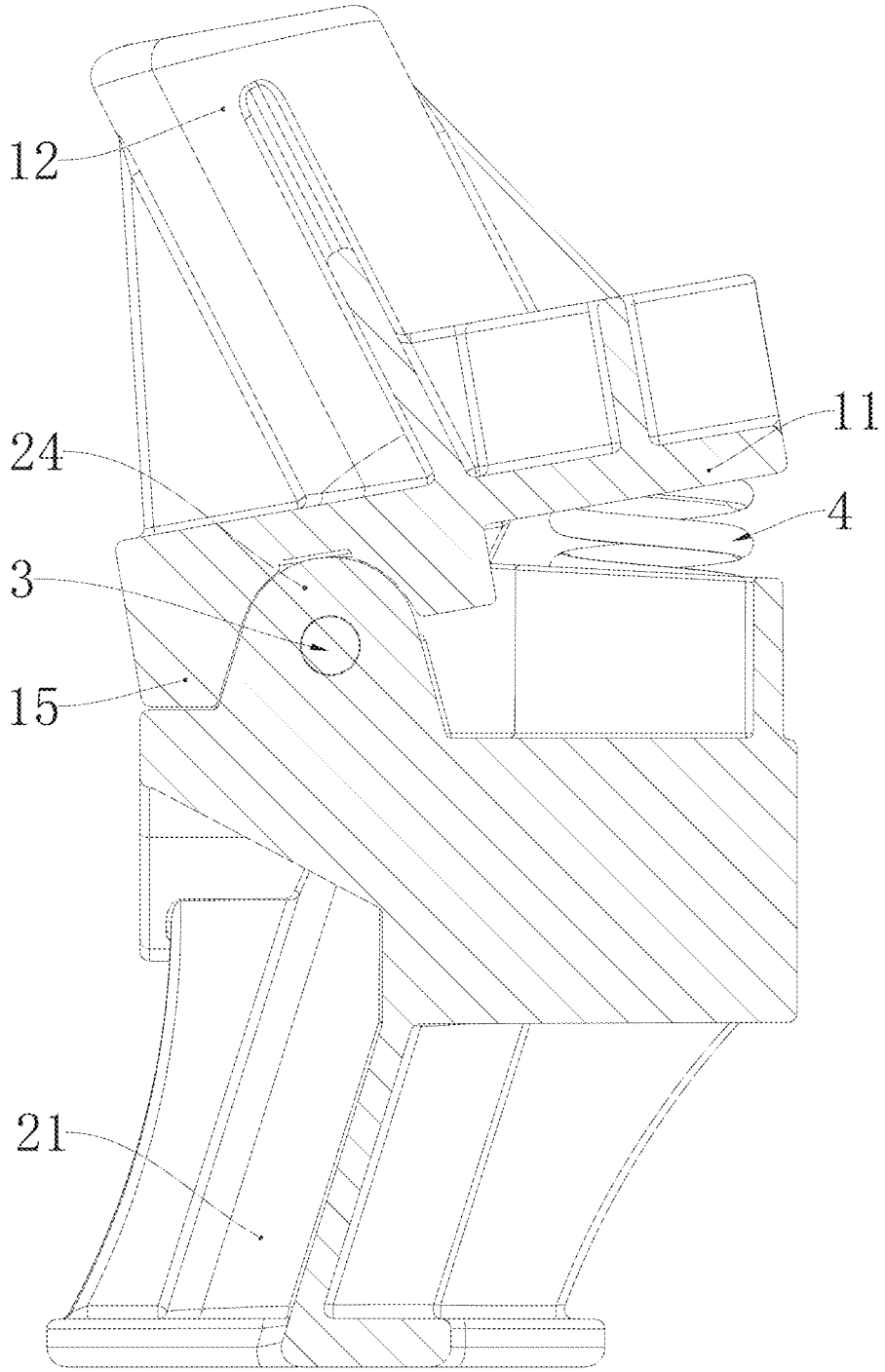
FIG. 5 is a half-sectional view of the upper support seat when it is rocked backward relative to the lower support seat in Embodiment 1 of the present disclosure.
Figure 6:
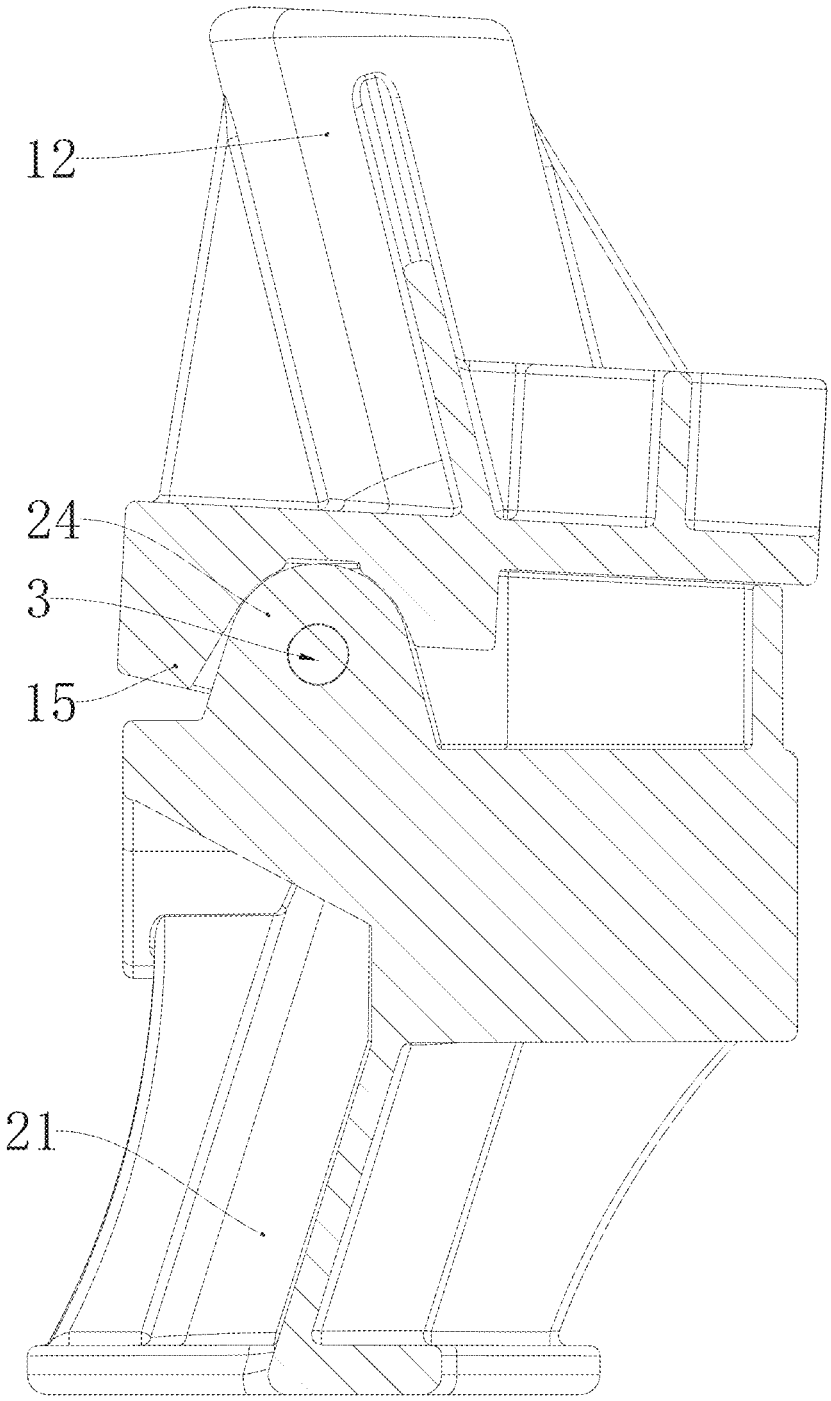
FIG. 6 is a half-sectional view of the upper support seat when it is tilted forward relative to the lower support seat in Embodiment 1 of the present disclosure.

Furthermore, as shown in FIGS. 5 and 6, the first limiting portion 15 and a second limiting portion are respectively provided on the upper support seat 1 and the lower support seat 2. In this embodiment, the second spring seats 25 have a raised platform structure which functions as the second limiting portion. When the upper support seat 1 swings to one end of its range of motion relative to the lower support seat 2, the first limiting portion 15 abuts against the lower support seat 2 to prevent excessive backward swing. When it swings to the other end, the upper ends of the second spring seats 25 abut against the upper support seat 1 to prevent excessive forward tilt, thereby ensuring that the range of the swinging motion remains within a reasonable range.

Specifically, when in use, the front support legs 8 and the rear support legs 5 cooperate with each other to form a stable force-bearing support structure, ensuring the stability of the rocking chair during use. The total number of the front support legs 8 and the rear support legs 5 is at least three, and the total number of the front support rods 9 and the rear support rods 6 is also at least three. In this embodiment, a design of two front support legs 8, two rear support legs 5, two front support rods 9 and two rear support rods 6 is adopted. The front support rods 9 always remain stationary, and the front edge of the chair fabric connected to their upper ends will not shift with the rocking, so that after the user sits down, the inner thighs can be stably rested on the front edge of the chair fabric. When the user leans forward or rocks back, the contact points of the thighs remain unchanged, giving the user a stronger sense of stability and security psychologically.

Figure 7:
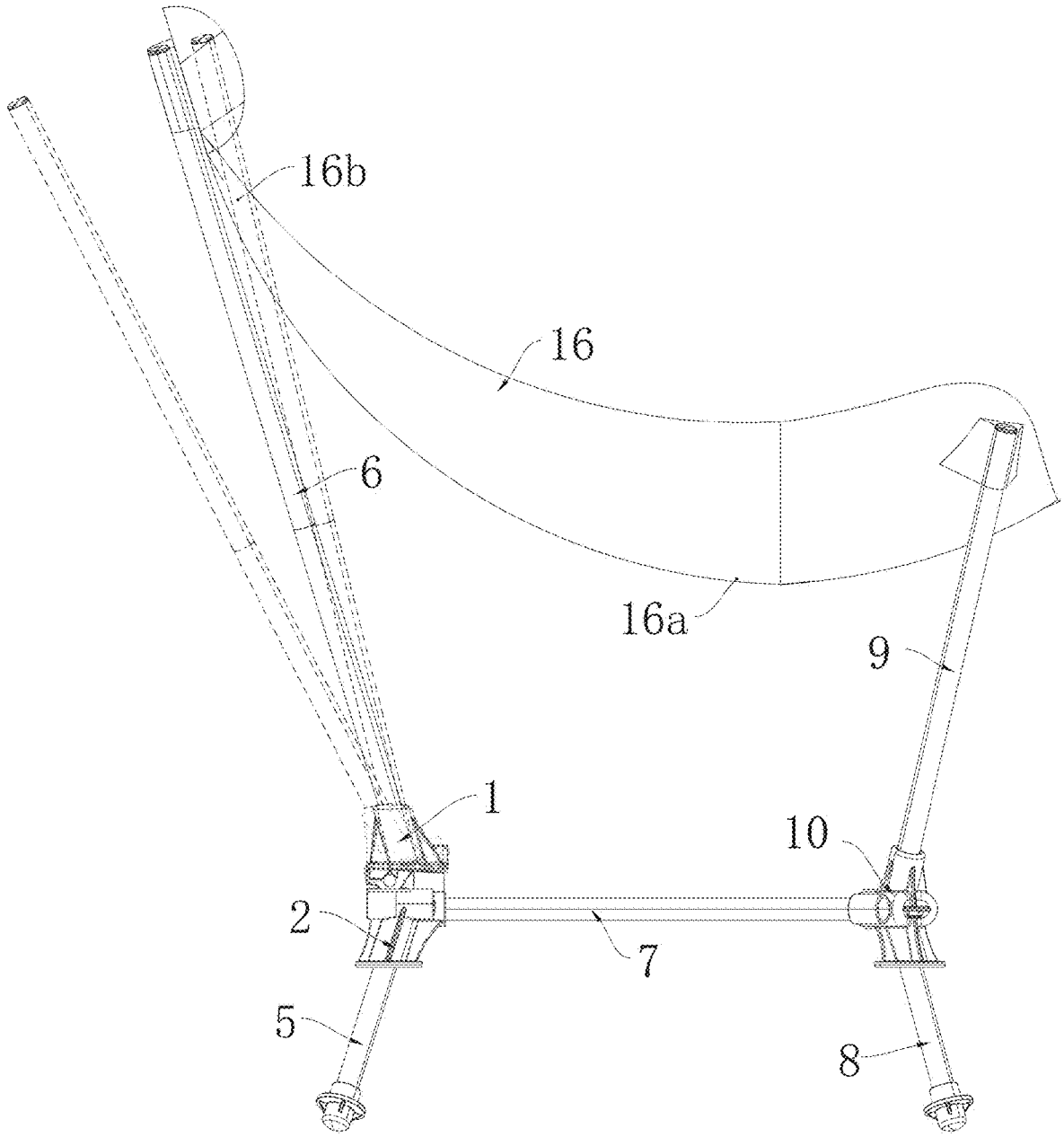
FIG. 7 is a side view of the rocking chair in Embodiment 1 of the present disclosure.

Furthermore, as shown in FIG. 7, the rocking chair has an initial state after being unfolded, and the upper support seat 1 is located at any angle between a forward tilt position and a backward rock position relative to the lower support seat 2. When a person sits on the chair fabric, the weight of the person is transferred to the upper support seat 1 through the chair fabric, causing it to slightly displace, and the seat surface of the chair cloth is moderately deformed, thereby improving wrapping and comfort. In another embodiment, the initial state corresponds to the forward tilt position, so that the seat surface is almost not deformed when the user is sitting down, and the sitting feeling is stable. Then, when the back is rested on the backrest area, the upper support seat 1 subsequently tilts backward and slowly returns to its position under the action of the elastic members 4. This further improves the user experience.

In this embodiment, the rocking chair is used as follows: the user first unfolds the rocking chair from a folded state, with the front support legs 8 and rear support legs 5 contacting the ground to form a stable support. The user sits on the seat of the chair fabric, and the weight of the body is transferred to the upper support seat 1 and drives the rear support rods 6 to swing, causing the backrest area to tilt forward. When the user's back rests against the backrest area of the chair fabric and applies a backward force, the rear support rods 6 swings backward, causing the backrest area to rock backward. Under the action of the elastic members 4, the backrest area can follow the rear support rods 6 to swing back and forth, thereby realizing the rocking function of the rocking chair. Since the front support rods 9 are stationary, the front edge of the chair fabric does not move. After use, the front support rods 9 and the front support legs 8 can be inserted into the second insertion grooves 10*c* of the plurality of connecting seats 10, and the rear support rods 6 and the rear support legs 5 can be inserted into the first insertion grooves 23 of the lower support seat 2 to achieve compact folding and storage.

Embodiment 2

Figure 12:
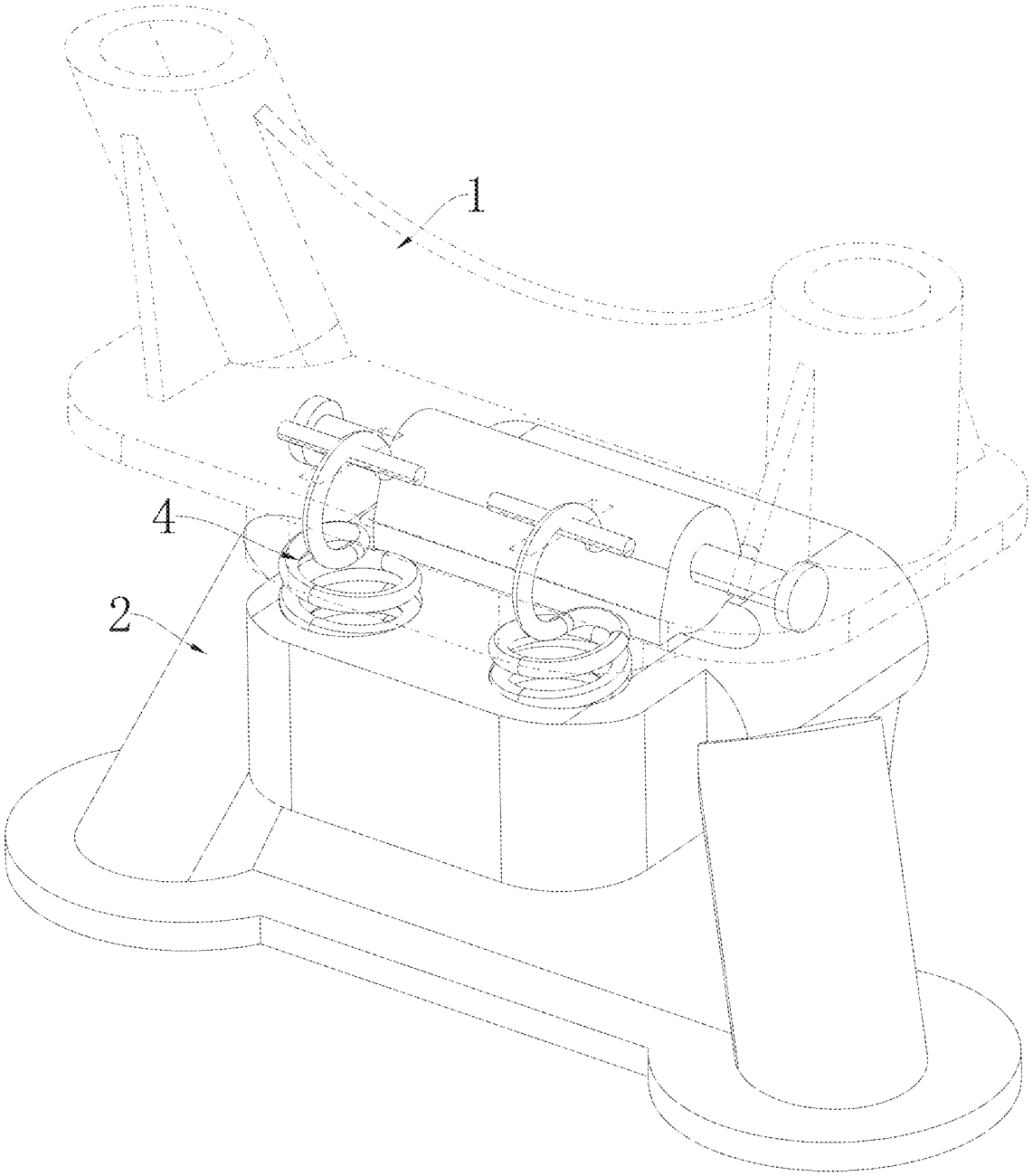
FIG. 12 is a perspective view of the upper support seat and the lower support seat in Embodiment 2 of the present disclosure.

As shown in conjunction with FIG. 12, the elastic members 4 can be modified in various ways. In this embodiment, the elastic members 4 are replaced by tension springs. The two ends of which are connected to the upper support seat 1 and the lower support seat 2 respectively. The tension springs are located behind the rotating shaft 3.

Embodiment 3

Figure 13:
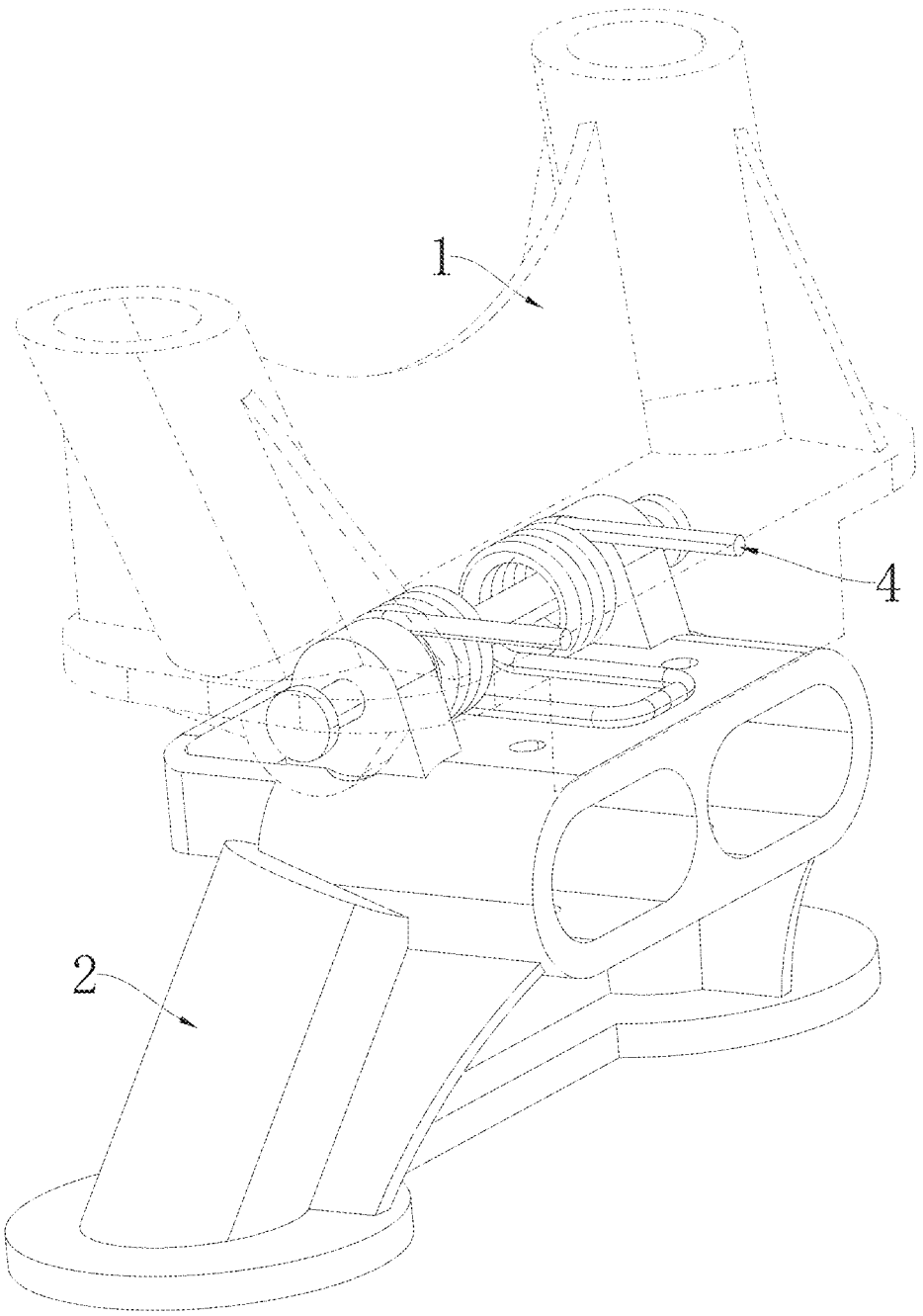
FIG. 13 is a perspective view of the upper support seat and the lower support seat in Embodiment 3 of the present disclosure.

As shown in conjunction with FIG. 13, in this embodiment, the elastic members 4 adopts torsion spring structure. The torsion springs are mounted on the outside of the rotating shaft 3, with their two ends respectively abutting against the lower end surface of the upper support seat 1 and the upper end surface of the lower support seat 2. In other embodiments, the spring members 4 may be leaf springs instead of the torsion spring structure in this embodiment.

In the description of the present disclosure, it should be understood that the terms "center", "longitudinal", "transverse", "length", "width", "thickness", "upper", "lower", "front", "rear", "left", "right", "vertical", "horizontal", "top", "bottom", "inside", "outside", "clockwise", "counterclockwise", "axial", "radial", "circumferential", etc., indicating the orientation or position relationship, are based on the orientation or position relationship shown in the accompanying drawings, and are only for the convenience of describing the present disclosure and simplifying the description, and do not indicate or imply that the device or element referred to must have a specific orientation, be constructed and operated in a specific orientation, and therefore cannot be understood as a limitation on the present disclosure.

In addition, the terms "first" and "second" are used for descriptive purposes only and should not be construed as indicating or implying relative importance or implicitly specifying the number of the technical features being referred to. Thus, a feature specified as "first" or "second" may explicitly or implicitly include at least one such feature. In the description of this disclosure, "plurality" means at least two, such as two or three, unless otherwise specifically defined.

Although the embodiments of the present disclosure have been shown and described above, it can be understood that the above embodiments are illustrative and cannot be understood as limitation on the present disclosure. Ordinary technicians in this field can change, modify, replace and modify the above embodiments within the scope of the present disclosure.

What is claimed is:

1. A portable rocking chair, comprising:

an upper support seat (1) and a lower support seat (2), the two being mutually limited and movably connected, the upper support seat (1) being connected to one or more rear support rods (6), the lower support seat (2) being connected to one or more rear support legs (5);

one or more front support rods (9) disposed forward of the rear support rods (6), upper ends of the front support rods (9) and upper ends of the rear support rods (6) configured to be jointly connected to a chair fabric, the chair fabric having a seat area and a backrest area for supporting buttocks and back of a human body respectively;

one or more front support legs (8) disposed forward of the rear support legs (5);

wherein, when the rocking chair is unfolded, the front support legs (8), the rear support legs (5), and the front support rods (9) remain in a stationary position relative to a ground, and the rear support rods (6) swing back and forth following movement of the upper support seat (1) relative to the lower support seat (2), thereby driving the backrest area of the chair fabric to tilt forward or rock backward;

wherein: the lower support seat (2) comprises a plurality of first insertion grooves (23), into which the rear support rods (6) and/or the rear support legs (5) are inserted and disposed in a front-to-rear direction in a folded state.

2. The portable rocking chair according to claim 1, wherein: an elastic member (4) is positionally mounted between the upper support seat (1) and the lower support seat (2), when the upper support seat (1) swings relative to the lower support seat (2), the elastic member (4) deforms and provides a restoring force for a swing.

3. The portable rocking chair according to claim 1, further comprising: a plurality of connecting rods (7), the plurality of connecting rods (7) being connected to the lower support seat (2) to form a horizontally disposed frame.

4. The portable rocking chair according to claim 3, wherein: the plurality of connecting rods (7) comprise a plurality of longitudinal connecting rods (71), one end of each of the plurality of longitudinal connecting rods (71)

being movably connected to the lower support seat (2), other ends of the plurality of longitudinal connecting rods (71) being provided with a plurality of connecting seats (10) for connecting a respective one of the front support legs (8) and/or a respective one of the front support rods (9).

5. The portable rocking chair according to claim 4, wherein: the plurality of connecting rods (7) further comprise a transverse connecting rod (72), the transverse connecting rod (72) being configured for connecting two of the plurality of connecting seats (10).

6. The portable rocking chair according to claim 4, wherein: the plurality of connecting seats (10) comprise a plurality of second insertion grooves (10*c*), into which the front support rods (9) and/or the front support legs (8) are inserted and disposed in a front-to-rear direction in a folded state.

7. The portable rocking chair according to claim 1, wherein: a spring clip (51) is provided in each of the rear support legs (5), and the spring clip (51) is engageable with the lower support seat (2).

8. The portable rocking chair according to claim 1, wherein: the upper support seat (1) or the lower support seat (2) is provided with a first limiting portion (15) for triggering limitation when moving to one end of a range of motion; and/or the upper support seat (1) or the lower support seat (2) is provided with a second limiting portion for triggering limitation when moving to another end of the range of motion.

9. The portable rocking chair according to claim 1, wherein: the rocking chair has an initial state after being unfolded, the upper support seat (1) is located at any position between a forward tilt position and a backward rock position relative to the lower support seat (2); or the rocking chair has an initial state after being unfolded, the upper support seat (1) is located at the forward tilt position or the backward rock position relative to the lower support seat (2).

10. A portable rocking chair, comprising:

an upper support seat (1) and a lower support seat (2), the two being mutually limited and movably connected, the upper support seat (1) being connected to one or more rear support rods (6), the lower support seat (2) being connected to one or more rear support legs (5);

one or more front support rods (9) disposed forward of the rear support rods (6), upper ends of the front support rods (9) and upper ends of the rear support rods (6) configured to be jointly connected to a chair fabric, the chair fabric having a seat area and a backrest area for supporting buttocks and back of a human body respectively;

one or more front support legs (8) disposed forward of the rear support legs (5);

wherein, when the rocking chair is unfolded, the front support legs (8), the rear support legs (5), and the front support rods (9) remain in a stationary position relative to a ground, and the rear support rods (6) swing back and forth following movement of the upper support seat (1) relative to the lower support seat (2), thereby driving the backrest area of the chair fabric to tilt forward or rock backward;

wherein: a spring clip (51) is provided in each of the rear support legs (5), and the spring clip (51) is engageable with the lower support seat (2).

* * * * *